US005518423A

United States Patent [19]

Green et al.

[11] Patent Number: 5,518,423

[45] Date of Patent: May 21, 1996

[54] SHIELDED CONNECTOR ASSEMBLY

[75] Inventors: Martin Green, Shelton; John A. Siemon, Woodbury, both of Conn.

[73] Assignee: The Siemon Company, Watertown, Conn.

[21] Appl. No.: 301,272

[22] Filed: Sep. 2, 1994

Related U.S. Application Data

[63] Continuation-in-part of Ser. No. 277,079, Jul. 19, 1994, abandoned.

[51] Int. Cl.[6] ..... H01R 13/658

[52] U.S. Cl. ..... 439/610; 439/557

[58] Field of Search ..... 439/535, 536, 439/557, 607, 610, 903

[56] References Cited

U.S. PATENT DOCUMENTS

| | | | |
|---|---|---|---|
| 4,717,358 | 1/1988 | Chaundy | 439/557 |
| 4,725,249 | 2/1988 | Blackwood et al. | 439/535 |
| 4,756,695 | 7/1988 | Lane et al. | 439/76.1 |
| 4,947,010 | 8/1990 | Heydner et al. | 439/557 |
| 4,964,812 | 10/1990 | Siemon et al. | 439/403 |
| 5,228,869 | 7/1993 | Below | 439/536 |
| 5,228,872 | 7/1993 | Liu | 439/607 |
| 5,295,869 | 3/1994 | Siemon et al. | 439/620 |
| 5,385,488 | 1/1995 | Clark | 439/557 |

OTHER PUBLICATIONS

AMP Incorporated, 110 Connect System, Jan. 1994.

ITT Datacommunications, RJ45 Data Jack Units (DJUs)–UK, May 28, 1992.

ITT Datacommunications, 16 Way 808 Patch Panels, May 28, 1992.

*Primary Examiner*—Neil Abrams

*Attorney, Agent, or Firm*—Fishman, Dionne & Cantor

[57] ABSTRACT

A shielded connector assembly having a snap locking mounting scheme. The assembly includes a panel yoke (2) with snap locking elements (21) for snap lockingly, removably securing the panel yoke (2) in a panel or cover plate. The panel yoke (2) is also constructed to snap lockingly engage a shielding device (30) which in turn is constructed to snap lockingly engage a connector assembly comprising an interconnecting device (61) which may be a printed circuit board (59) including integrally defined reactive elements designed to compensate for reactive imbalance of electrical components connected thereto. A pair of wire termination blocks (70) mounted to a first side of the circuit board are connected by circuitry on the circuit board to a corresponding modular jack (60) mounted on a second side of the circuit board. The reactive elements produce an impedance between selected leads of the modular jack and the wire termination blocks by the circuitry. A snap locking combination of the shield device (30) and a shielding cover (90) completely shields the connector assembly (61). For joining the assembly parts, the shield includes pawls (32) and engagement members (33) that latch to cutouts (18) in the yoke and to apertures (94) in the shield cover, respectively. The shield device (30) includes a cable shield restraint (36). In one embodiment, a dual opening yoke receives two shielding devices. In another embodiment, a single opening yoke receives one shielding device.

45 Claims, 13 Drawing Sheets

SHIELDED CONNECTOR ASSEMBLY

CROSS-REFERENCE TO RELATED APPLICATIONS

This is a continuation-in-part of U.S. application Ser. No. 08/277,079 filed Jul. 19, 1994, now abandoned.

BACKGROUND OF THE INVENTION

1. Field of the Invention

This invention relates to shielded interconnection schemes for use primarily with telecommunications devices. More particularly, the invention provides an organized substantially shielded interconnection assembly for interconnecting a shielded cable and a modular plug.

2. Prior Art

Many different shielded connector units are presently available. For example: AMP#9222 557375-1 is a small shielded connector shielding a single modular jack. The design, however, suffers from an inherent drawback in that a large opening is left in the shielding where a plastic snap locking means is placed. Since plastic does not inhibit the transmission of radio waves, the unit is subject to interference despite its otherwise shielded structure. Other examples of prior art shielded connector devices include ITT's Cannon CEG and Amp's 257-1 which is a unit meeting category 5 criteria. The Amp unit although meeting category 5 criteria is very large and leaves several openings unshielded which reduce the total shielding effectiveness. These prior art devices all utilize a PC board with wire termination blocks mounted thereon, the boards and blocks as well as modular connectors being disposed within shielding devices of various shapes, materials and degrees of shielding. Yet, other better shielded connectors are sought.

SUMMARY OF THE INVENTION

The above-discussed and other drawbacks and deficiencies of the prior art are overcome or alleviated by the shielded connector assembly of the invention.

The present invention provides a shielded connector assembly, which can be utilized with shielded cable whether balanced or unbalanced, is compact, relatively easy to manufacture and relatively inexpensive. The unit is furthermore category 5 compliant.

The invention comprises a panel yoke similar to that disclosed in U.S. Pat. No. 5,228,869 assigned to the assignee hereof and incorporated herein by reference, adapted to snap fittingly engage a shielding enclosure so that said enclosure is properly oriented with respect to a modular plug access opening in the panel yoke. The shielding enclosure includes bent metal tabs for snap lockingly engaging the panel yoke. The shielding enclosure also includes apertures for engaging protrusions on a PC board or other modular jack mounting surface so that the mounting surface is securely maintained in a predetermined position within the shielding enclosure, such position ensuring that the modular jack mounted thereon is in a position complementary to the opening in the panel yoke for a modular plug. The shielding enclosure also includes a cable restraint/shield connection adapted to be utilized either with or without a drain wire. The shielding assembly is completed with a shielding rear cover which snap lockingly engages the shielding enclosure. Cable enters the shielding assembly through an orifice in the rear wall (or partially in the rear wall and partially in a side wall) of the rear cover.

When all of the elements discussed above are assembled, a compact substantially completely shielded telecommunications connection interface is provided where holes in the shield are minimized.

As mentioned, the shielded connector assembly uses either a PC board or other mounting surface for the modular jack; where a PC board is utilized, one similar to that disclosed in U.S. Pat. No. 5,295,869, assigned to the assignee hereof, the entire disclosure of which is incorporated herein by reference, is preferred.

In accordance with the present invention, a printed circuit board includes integrally defined reactive elements designed to improve electrical balance between the pairs in the modular jack and thereby optimize its crosstalk performance. The reactive elements are provided by means of plated through holes that are arranged and interconnected in a grid pattern on the printed circuit board. The holes may be sized, spaced and interconnected in various configurations to generate the desired reactance. This method of tuning reactive balance between pairs makes use of well known elements of printed circuitry to produce a new desired effect. An extremely repeatable and economical means of adding reactance to electrical circuits is obtained by the method of the present invention. A pair of wire termination blocks similar to those disclosed in U.S. Pat. No. 4,964,812 assigned to the assignee hereof and incorporated herein by reference, are mounted to a first side of the circuit board preferably by solderless means and are connected by circuitry on the circuit board to a corresponding modular jack mounted to a second side of the circuit board. The reactive elements are connected between selected leads of the modular jack and the wire termination blocks by the circuitry. It should be noted that the termination block of U.S. Pat. No. 4,964,812 comprises a housing which includes a plurality of spaced apart teeth along the length of its upper surface. The teeth are alternated and staggered in height to facilitate indexing of wire conductors in wire strain relief slots. Also, as is conventional with connecting blocks of this type, the teeth include tapered sides to facilitate entry of the wire conductors. Termination blocks are used independently of PC boards and in conjunction with them. These are utilized in both shielded and unshielded connections.

The assembly of the present invention provides a connector scheme that meets or exceeds Category 5 transmission requirements as defined in TSB40. Therefore, the assembly of the present invention provides many of the aforementioned advantages for which Category 5 was established.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE PREFERRED EMBODIMENT

Figure 1:
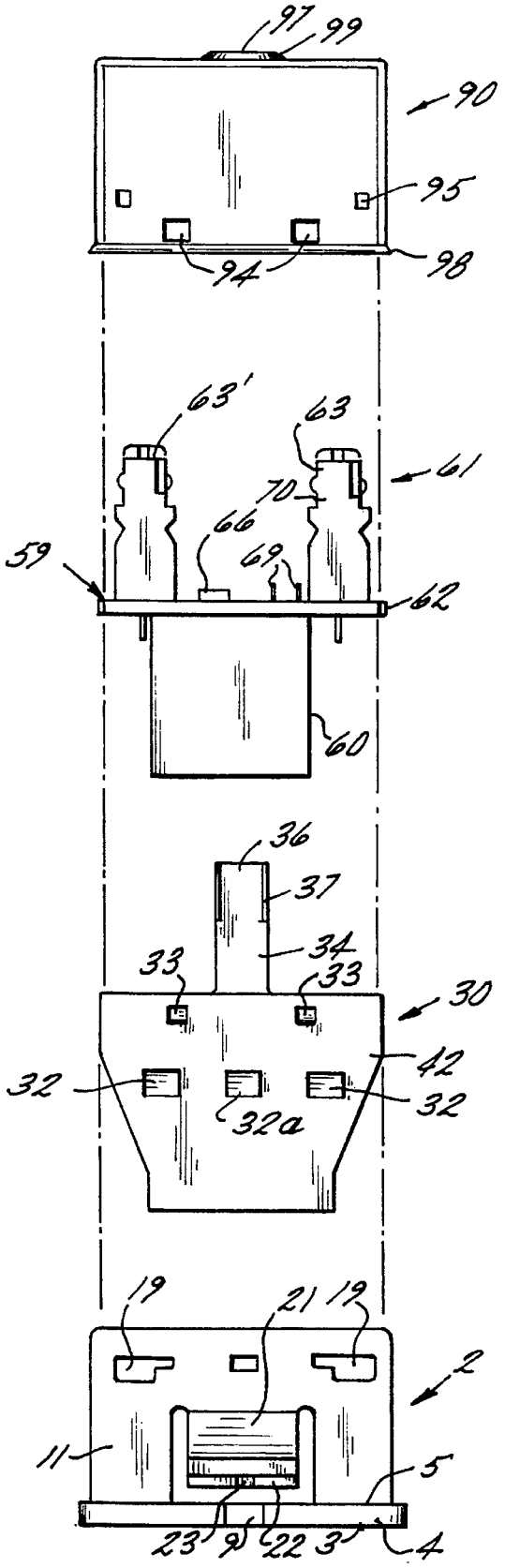
FIG. 1 is an exploded view of the invention.
Figure 4:
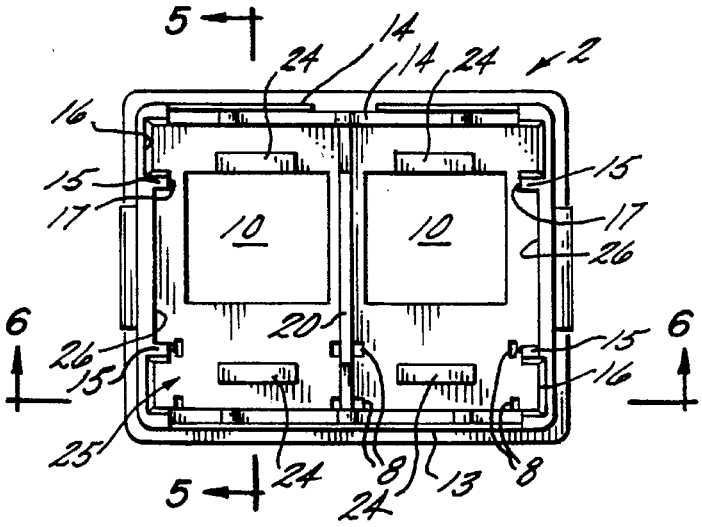
FIG. 4 is a rear plan view of the panel yoke of the invention.
Figure 3:
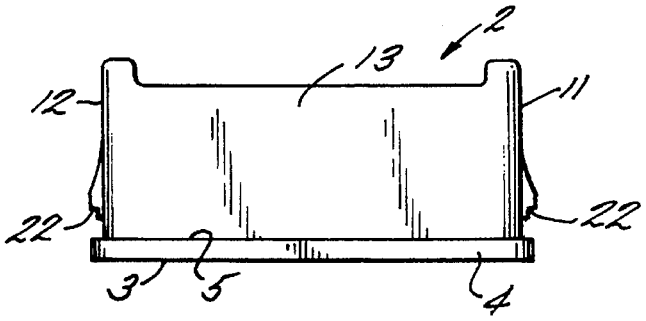
FIG. 3 is a plan view of the panel yoke of the invention.
Figure 2:
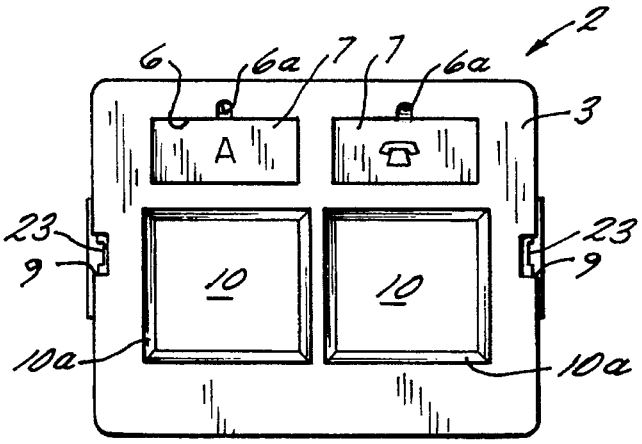
FIG. 2 is a front view of the panel yoke of the invention.

Referring to FIG. 1, an exploded view of the elements of the invention will aid one of skill in the an in understanding the several other figures briefly described above.

At the bottom of the page of FIG. 1, numeral 2 identifies a side view of a panel yoke of the invention. Panel yoke 2 is illustrated in more detail in FIGS. 2–7.

Referring now to FIGS. 1–7 simultaneously, panel yoke 2 comprises a front faceplate 4 having a pair of recesses 6, each for engaging an insert 7 in a snap locking engagement. Each insert 7 is identified with a symbol, icon, alphabetical or numeric designation, or is color coded to provide identification for each of preferably two but at least one opening(s) 10 which provide access to a modular jack 60 mounted therebehind. Front face plate 4 of panel yoke 2 includes opposing surfaces 3 and 5. Extending from facing surface 3, and perimetrically bordering each opening 10, are chamfered edges 10*a*, said edges 10*a* extending from said facing surface 3 in a direction toward a center of each respective opening 10 while proceeding toward opposing surface 5. The facing surface 3 preferably is a textured finish but may be of any desired finish. Within front face 4, adjacent recesses 6, are recess extensions 6*a* provided to facilitate removal of inserts 7. Removal of inserts 7 is effected by inserting a thin object (not shown) into recess extension 6*a* of each recess 6, and prying out insert 7. An aperture 8 is located at each of the four corners of each recess 6. Front face 4 further includes a pair of channels 9 at opposing sides of front face 4 to provide access to a pair of resiliently defeatable cantilevered arms which secure panel yoke 2 to a panel. The arms will be discussed hereunder.

The opposing surface 5 of front face plate 4 meets opposing side walls 11 and 12 and opposing top and bottom walls 13 and 14. The two sets of opposing walls preferably extend generally perpendicularly rearwardly from, or from adjacent to, opposing surface 5 and preferably substantially in the shape of a parallelogram. All walls 11, 12, 13 and 14 are preferably interconnected at the corners of front face 4.

Side walls 11 and 12 each include a pair of stiffening ribs 15 which extend from opposing surface 5 of front face plate 4 along inner surfaces 26 of side walls 11 and 12 and terminate coextensively with the rear inwardly chamfered edge 16 of side walls 11 and 12. Along each stiffening rib 15, extending therefrom on an angle, and connecting opposing surface 5 of front face plate 4, are orientation guides 17. These guides help to position the shielding enclosure (discussed hereunder) for proper alignment with openings 10 in front face plate 4. Moreover, an important feature of ribs 15 is a cutout 18 in each rib, distal from opposing surface 5. This cutout is positioned to engage a bent pawl on the shielding enclosure to secure said shielding enclosure to the panel yoke 2. Cutout 18 is preferably provided by extending a pair of ports 19 through each side wall 11 and 12, which ports intersect ribs 15 so that a small portion of molded rib 15 is removed in each case.

Sidewalls 11 and 12 further include a molded in cantilevered arm 21 (one in each sidewall) for snap lockingly securing panel yoke 2 in a wall or appropriate receptacle, i.e. a panel (not shown) cantilevered arms 21 extend forwardly from the back of sidewalls 11 and 12 of yoke 2 toward face plate 4. Arms 21 each include a retaining edge 22 and a seat 23. Arms 21 are urged inwardly when yoke 2 is inserted into the wall receptacle and snap back when yoke 2 is fully inserted to securely maintain yoke 2 within the receptacle (not shown). Yoke 2 may be removed from the wall receptacle for maintenance and various other reasons, by inserting a rigid member between the wall receptacle border and yoke 2 at channel 9, the rigid member (not shown) being inserted into seat 23 of arm 21 whereafter arms 21 are urged inwardly by force applied to the rigid member until edges 22 are disengaged from the wall receptacle so that yoke 2 is free to be removed.

Top wall 13 and bottom wall 14 extend from, or extend from adjacent to, opposing surface 5 and are preferably supported by interconnection with side walls 11 and 12 at the corners of face plate 4 and by a bisecting center wall 20 which also serves to divide the yoke 2 into two compartments 25 for each modular jack.

Finally, opposing surface 5 of face plate 4 includes pedestals 24 extending from opposing surface 5 adjacent to a top edge and bottom edge of each opening 10. Four pedestals 24 are present and they help to position the shielding assembly and modular jack correctly within the compartments defined by the elements recited above.

In an alternate embodiment of the invention a single opening panel yoke 101 is disclosed. It should be noted that the figures illustrating this embodiment are numbered and discussed only to the extent that alternate features are illustrated. Other features are substantially similar to the embodiment disclosed above and do not require detailed discussion hereunder. Single opening panel yoke 101 is illustrated in FIGS. 31–36 in various views and cross sections. The single opening panel yoke 101 is specifically constructed to house one modular jack (illustrated in previous figures) while maintaining substantially the same overall dimensions as the two opening panel yoke described hereinbefore. Essentially, one of the openings 10 having chamfered edges **10*a* shown in FIG. 2 has been repositioned centrally relative to the face plate 104 of single opening panel yoke 101. To avoid confusion, the opening and chamfered edge in single opening panel yoke 101 has been numbered 110 and 110*a***, respectively.

Figure 33:
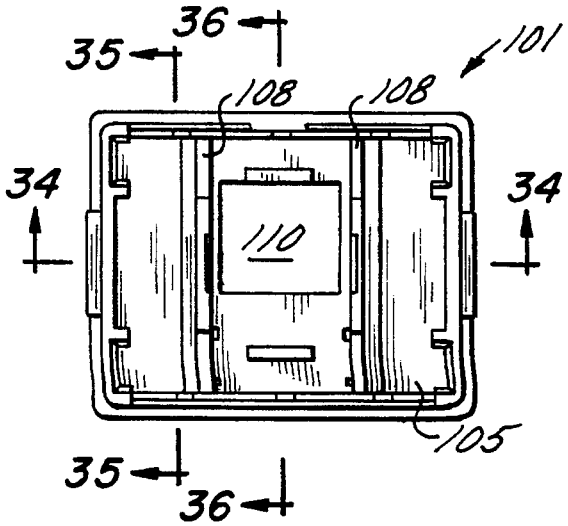
FIG. 33 is a rear plan view of an alternate embodiment of the panel yoke of the invention.

Referring to FIG. 33, several features of the alternative embodiment are illustrated. Two engagement supports 108 extend from a rear surface 105 of yoke face plate 104 in a substantially perpendicular direction to that of the face plate 104. Engagement supports 108 are oriented proximately to opening 110 and on either side thereof so that a shield enclosure such as that discussed above or the embodiments discussed hereinbelow may engage the engagement supports 108 when correctly positioned in alignment with opening 110. An engagement cell 109 see FIG. 36) is provided in engagement support 108 to receive middle pawls **32*a*** to retain the enclosure in the desired position. It will be noted that the panel yoke is otherwise substantially similar to the two opening yoke above described.

Figure 34:
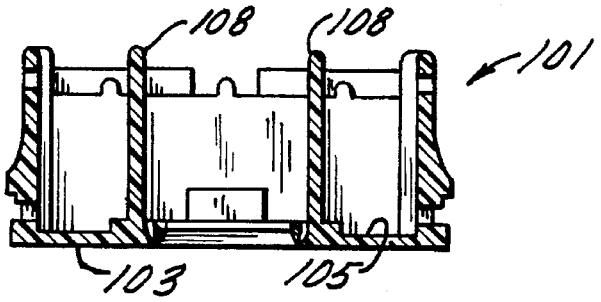
FIG. 34 is a cross section view of FIG. 33 taken along section line 34—34.
Figure 35:
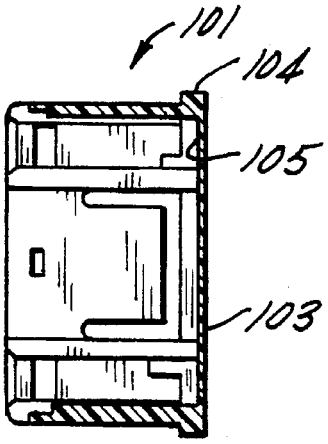
FIG. 35 is a cross section view of FIG. 33 taken along section line 35—35.
Figure 36:
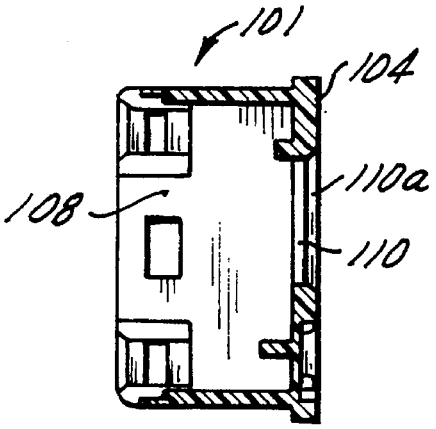
FIG. 36 is a cross section view of FIG. 33 taken along section line 36—36.

FIGS. 34, 35 and 36 are provided and numbered for a clearer understanding of this embodiment. It should be noted that selected structures which are similar to the structures illustrated in FIGS. 2–7 are numbered alike in these figures.

The second component of the shielded connector assembly of the invention, shown as the second element from the bottom of drawing FIG. 1, and detailed in drawing FIGS. **8–14*a*, is the shielding enclosure 30**. Shielding properties are effected by choice of material or the coating of a structurally capable material with a radio transmission inhibiting substance. Structurally capable materials include metal, plastic, etc. Most preferably, the substance utilized herein is a tin lead alloy over brass.

Figure 5:
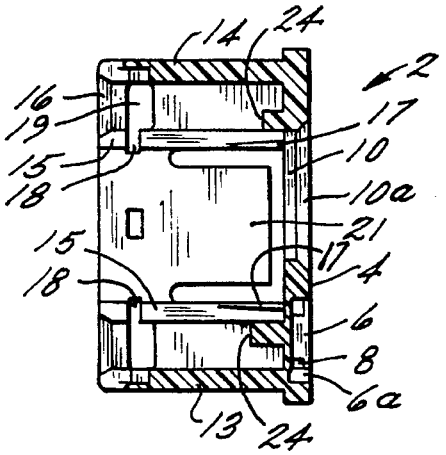
FIG. 5 is a cross section view of the yoke taken along section line 5—5 in FIG. 4.
Figure 6:
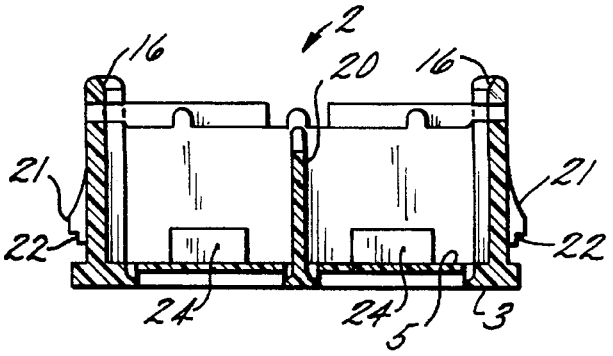
FIG. 6 is a cross section view of the yoke taken along section line 6—6 in FIG. 4.
Figure 7:
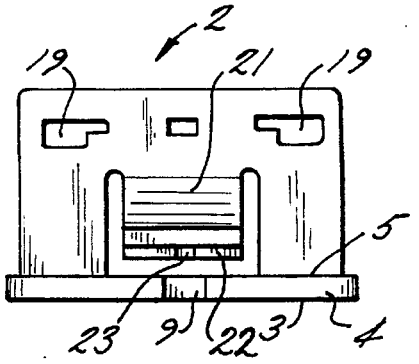
FIG. 7 is a side view of the panel yoke of the invention.
Figure 8:
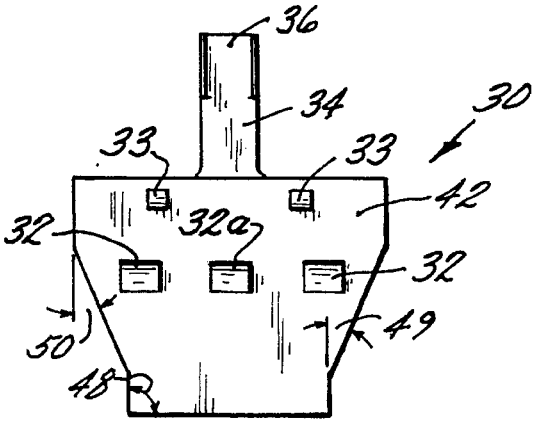
FIG. 8 is a left side elevation view of the shielding enclosure of the invention.
Figure 13:
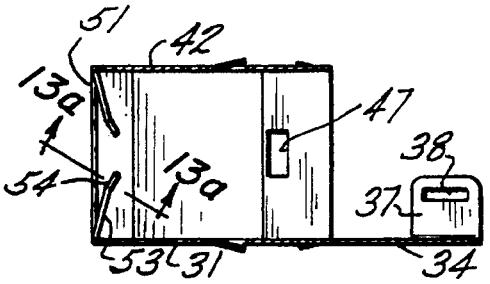
FIG. 13 is a cross sectional view taken along section line 13—13 in FIG. 9.
Figure 12:
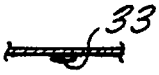
FIG. 12 is a cross sectional view taken along section line 12—12 in FIG. 10.

As can be ascertained from drawing FIGS. 1, 5 and **8–14*a*, which are referred to simultaneously for the ensuing discussion, shielding enclosure 30 is of a relatively complex polygonal shape. It should be noted that there are right and left side enclosures 30 to mate with right and left compartments 25 in the panel yoke 2. The right side/left side distinction is important only insofar as the appendage 34 (discussed hereunder) is on opposite side panels of each of the right and left side shielding enclosures. In all other respects the enclosures are identical and only one side will be described in detail. The shape has been developed to ensure a positive engagement and alignment with yoke 2, while helping to minimize the dimensions of the entire shielded connector assembly. The shielding enclosure includes two major side plates. Right side plate 31 includes bent pawls 32 for engaging cutout 18 in stiffening rib 15 of yoke 2. As is clear from a brief perusal of FIGS. 8–14*a*, particularly noting FIGS. 13 and 14, pawls 32 are angled (or bent) away from the body of enclosure 30 which provides a ramp effect the ramp effect the ramp leading from a more forward location on enclosure 30 to a more rearward location of enclosure 30. These pawls 32 are urged inwardly by ribs 15 (FIG. 5) until the enclosure is fully seated in the compartment in which it has been inserted. At this time, pawls 32 will snap into cutout 18 to provide resistance with respect to the removal of enclosure 30 from the compartment. Pawls 32 retain shielding enclosure 30 in an engaged aligned position in yoke 2. Pawls 32 also are placed on left side plate 42, but in the preferred embodiment only two pawls 32 are utilized in each compartment 25, as engagement cutouts 18 exist only on side walls 11 and 12 of yoke 2 and no engagement means is positioned on center wall 20; if a single compartment panel yoke is utilized, however, the middle pawl 32*a* will engage the side walls and such engagement will be on both sides simultaneously. The pawls 32 should, however, be located on both sides of the shielding enclosure since the shielding enclosure must maintain the same orientation from side to side of yoke 2 (i.e. the shielding enclosure cannot be flipped around to have the same set of pawls 32 engage the side walls 11 or 12 from either compartment 25). When both compartments are used (i.e., a shielding enclosure on each side of center wall 20) the shield enclosure 30 having the shield restraint 37 or 39 on the outside of the shield 30 furthest from 26 is utilized. As one of skill in the art will appreciate, the off center location of openings 10 in yoke 2 and the need for proper alignment among opening 10 and access opening 52 in shielding enclosure 30, prevents "flipping" the shielding enclosure around. Right side plate 31 further includes two bent and rounded engagement members 33 for engaging apertures 94 in the shielding rear cover 90 (to be discussed hereunder). The engagement members are rounded as best illustrated in FIG. 12 to facilitate the disengagement of the shielding rear cover when necessary. Were the engagement members 33 not curved, it has been determined that they have a tendency to slip through the engaging apertures 94** thereby making removal of the cover difficult.

Figure 39:
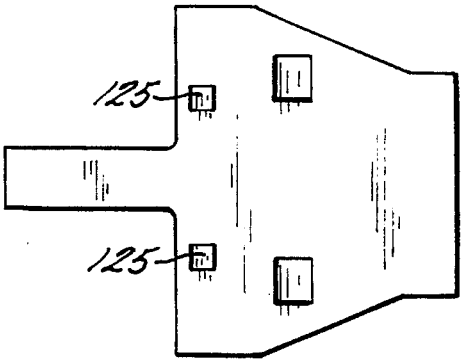
FIG. 39 is a side view of a generic shielding enclosure illustrating an alternate latch for the rear cover.
Figure 39A:
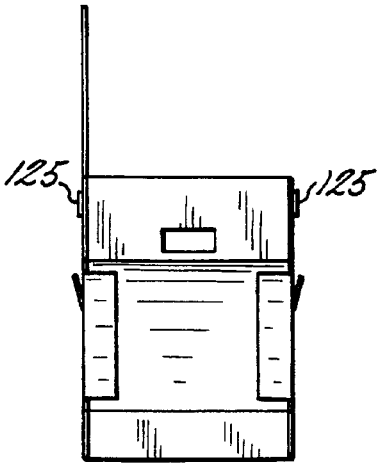
FIG. 39*a* is an elevation view of the shielding enclosure of FIG. 39.
Figure 39B:
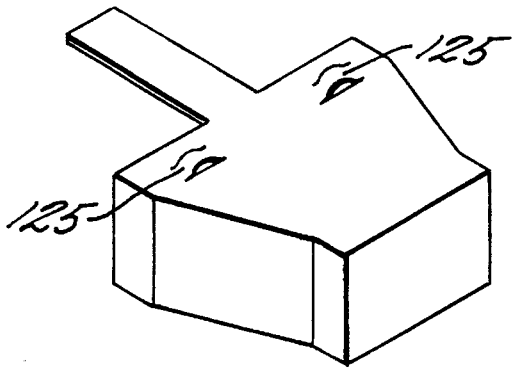
FIG. 39*b* is a perspective diagrammatic view of FIGS. 39 and 39*a*.

FIGS. 39, 39*a* and 39*b* illustrate a shielding enclosure in a generic form to focus attention on an alternate latch construction for engagement with engagement apertures 94 on shielding rear cover 92. In FIG. 39 the only numbered portions are latches 125. Latches 125 are cut at lea and right on the drawing. The material between the cuts is then stretched outwardly so that it is engageable with engagement apertures 94. This arrangement eliminates the occasional difficulty associated with the engagement members 33 described hereinabove and additionally prevent the cover from being pushed on too far.

Figure 40:
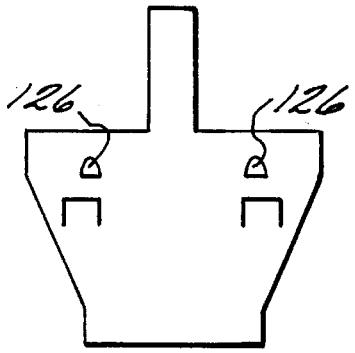
FIG. 40 is a side view of a generic shielding enclosure illustrating another alternative latch for the rear cover.
Figure 41:
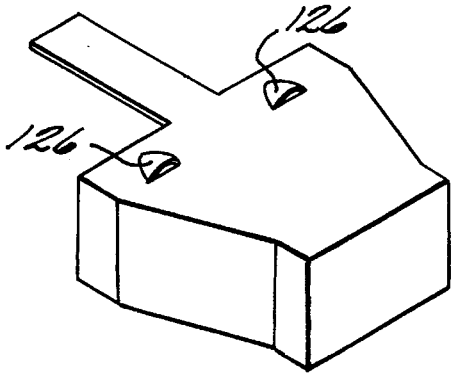
FIG. 41 is an enlarged diagrammatic perspective view of the latch of FIG. 40.

Another embodiment for securing the shielding enclosure 30 to shielding rear cover 92 is illustrated in FIGS. 40 and 41. Latch 126 is formed by cutting only one line into the material of shielding enclosure 30 and stretching the material outwardly. This provides an angled surface 127 to make engagements of the shielding rear cover easier for the user. The angled surface 127 is best appreciated from the enlarged perspective view of FIG. 41. FIG. 41 is a perspective view of a generic shielding enclosure to illustrate the latch 126 in perspective view.

Figure 14A:
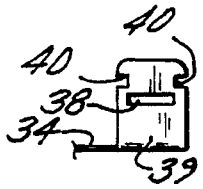
FIG. 14*a* is an alternate embodiment of the shield restraint shown in FIG. 14.
Figure 14:
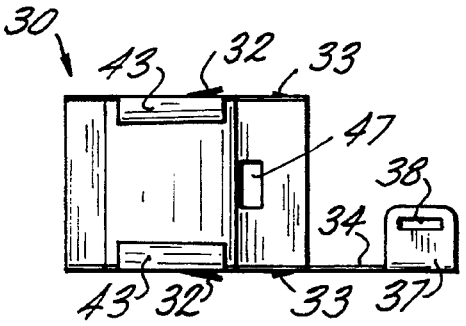
FIG. 14 is a plan view of the shielding enclosure.
Figure 10:
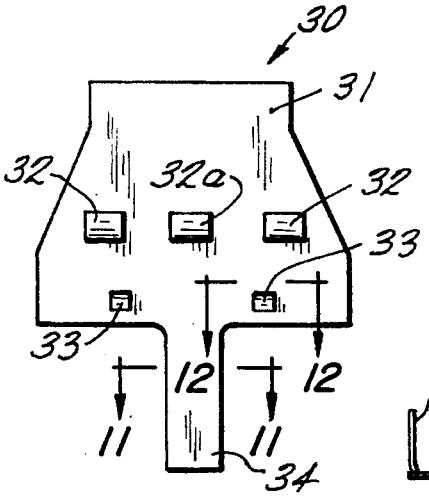
FIG. 10 is a right side view of the shielding enclosure of the invention.
Figure 11:
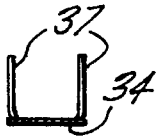
FIG. 11 is a cross sectional view taken along section line 11—11 in FIG. 10.

Also included on side plates 31 is an appendage 34 containing a cable shield restraint 36 (FIGS. 14, 14*a*, 37, 37*a*, 38 and 38*a*). Cable restraint 36 contains four preferred embodiments. Referring to FIG. 14 and 14*a*, the cable restraint 36 is for use without a drain wire; note numeral 37. Restraint 36 can comprise either of two wing portions 37 or 39 extending in opposite directions from the appendage 34, which are to be bent into a u-shape to cradle the shielded cable. Each wing 37 includes a passage 38 for engagement of any of a number of conventional tie down arrangements (not shown). Where restraint 36 includes wing portions 39, sockets 40 are provided. Restraint 36 does, in both instances, provide a passage 38 on each wing 37 or 39. Referring to FIGS. 37, 37*a*, 38 and 38*a*, a cable restraint 36 is provided having an entirely different appendage 34*a* and an alternate cable engagement section 115. Appendage 34*a* comprises, preferably, three distinct members: a spike 116 or 119 and a pair of cable retention members 117 or 120 respectively. The spike 116 or 119 is preferably curved with a radius bend similar to the circumferential arc of a cable and includes a tapered head 118. The curvature and tapered head 118 facilitate insertion of the spike into a cable, either between the sheath and shield or between the shield and the twisted pairs. It should be noted that spike 116 or 119 are of different lengths. Long spike 116 extends further into the cable for electrical connection while short spike 119 is augmented in retention by cable retention members 120 which include burr 123 on each member 120 for easier fit of cable. Both cable retention member pairs 117 and 120 include lugs 121. Lugs 121 provide for positive engagement of any conventional tie (not shown) which is utilized to bind the cable to the shield restraint.

Figure 37:
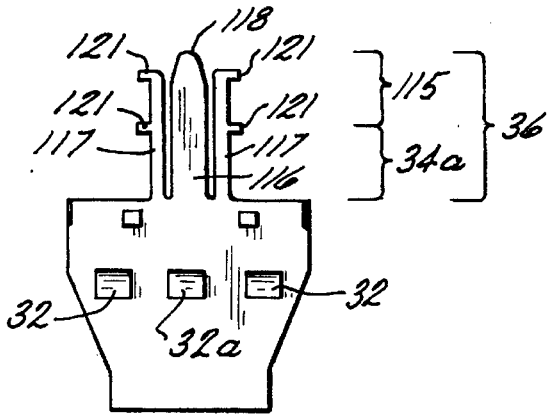
FIG. 37 is a side view of the shielding enclosure with an alternate shield restraint.
Figure 37A:
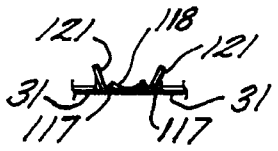
FIG. 37*a* is an end view of the shield restraint of FIG. 37.
Figure 38:
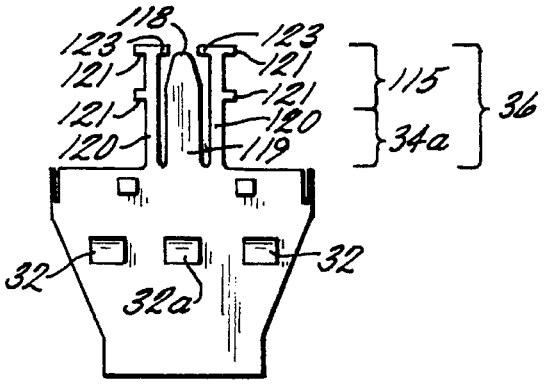
FIG. 38 is a side view of the shielding enclosure with another alternate shield restraint.
Figure 38A:
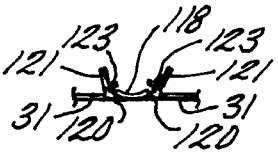
FIG. 38*a* is an end view of the shield restraint of FIG. 38.

In FIGS. 37 and 38 the cable restraint 36 is portrayed flat whereas in FIGS. 37*a* and 38*a* the cable restraints 36 is shown in the bent (operable) position. It should be appreciated that the view of FIGS. 37*a* and 38*a* should show the interior of shielding enclosure 30, however to increase clarity of the alternate embodiments of cable restraint 36, the view has been restricted thereto. The horizontal section of each of FIGS. 37*a* and 38*a* is a small portion of side plate 31 of shielding enclosure 30.

In the bent (operable) position of cable restraint 36 shown in FIGS. 37*a* and 38*a* it is evident that cable retention members 117, 120 are twisted over their length to orient the ends thereof, distal from the shielding enclosure 30, in a parabolic shape relative to one another. In the case or members 117 this bending is all that is necessary, however in the case of members 120 which have the additional burr 123, a further step of bending the burr 123 from each member 120 toward spike 119 and to about 90° to the bent direction of lugs 121 on each respective member 117 is necessary.

Left side plate 42 is identical to right side plate 31 except for the appendage 34 and cable restraint 36.

Figure 9:
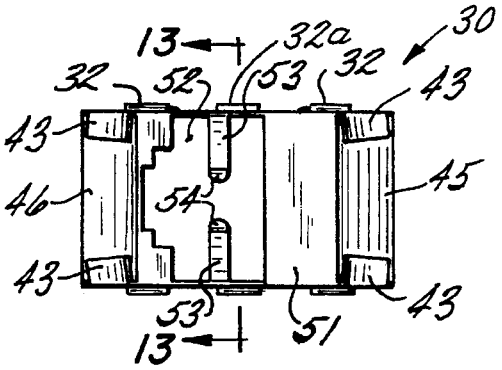
FIG. 9 is a front view of the shielding enclosure of the invention.

One additional feature present on both left and right side plates 42, 31 are a pair bent tabs 43 (see FIG. 9). Each tab is bent at an angle of about 90° to the plane of side plates 31, 42 and are meant to abut a top and a bottom plate 45 and 46 of shielding enclosure 30. Bent tabs 43 may be welded, soldered, adhesively attached or otherwise secured to top and bottom plates 45, 46 or simply maintained in place by the homeostasis created by the completely assembled shielded connector assembly.

Top plate 45 and bottom plate 46 are extensions of a forward plate 51 and are bent on an angle 48 therefrom of about 90° . These plates 45, 46 then proceed in approximately mirror image of each other toward the rear of shielding enclosure 30. In order to accommodate the size of the interconnecting apparatus 61 for connecting cable wires to the modular jack 60, which interconnecting apparatus 61 is snap-lock fit into shielding enclosure 30, top and bottom plates 45, 46 bend outwardly approximately 35° at angle 49 and then bend inwardly to a direction parallel to the first section at angle 50. Coextensive with the bend line of angle 50 is perforation 47 which exists on both top and bottom plates 45, 46. Perforations 47 are adapted to engage projection 62 on interconnecting apparatus 61.

Figure 13A:
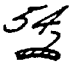
FIG. 13*a* is a cross sectional enlarged view taken along section line 13*a*—13*a* in FIG. 13.
Figure 15:
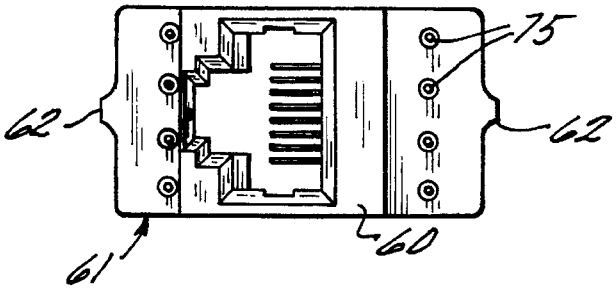
FIG. 15 is a front view of the modular jack mounted on a mounting surface.

Forward plate 51 (best illustrated in FIG. 9) is preferably generally rectangular in shape and includes an access opening 52 which is sized and shaped to provide access to a modular plug (not shown) to engage a modular jack 60 which will reside immediately behind forward plate 51. It should be noted that forward plate 51 is not only coextensive with top plate 45 and bottom plate 46 but it is also coextensive with side plates 42 and 31 (i. e. both side plates and the top and bottom plate are bent from the forward plate 51 at about 90°). Extending into access opening 52 are resilient fingers 53. Fingers 53 extend inwardly toward each other from the boarder between plate 51 and each side plate 31, 42. Fingers 53 are pushed back when the modular plug is used. Fingers 53 may also be pushed back in manufacturing. Each finger 53 has a radius along its length (best viewed in FIG. 13*a*) and also includes a curved end section 54 (best viewed in FIG. 13). It has been found that the combination of the radius and curved end sections 54 on fingers 53 improve contact integrity and cycle life.

Another important subassembly of the invention is the modular jack and interconnecting means which are illustrated in FIGS. 15–20. Modular jack 60 is conventional and does not require discussion. Interconnecting apparatus 61 may be of any type including hard wiring or PC board connected. In the most preferred embodiment of the invention a PC board is utilized. The interconnecting apparatus 61, whatever the type, includes projections 62 which engage perforations 47 in top plate 45 and bottom plate 46 of shielding enclosure 30. Interconnecting apparatus 61 is thus securely mounted within shielding enclosure 30 such that modular jack 60 extends to immediately behind forward plate 51 of shielding enclosure 30.

Figure 16:
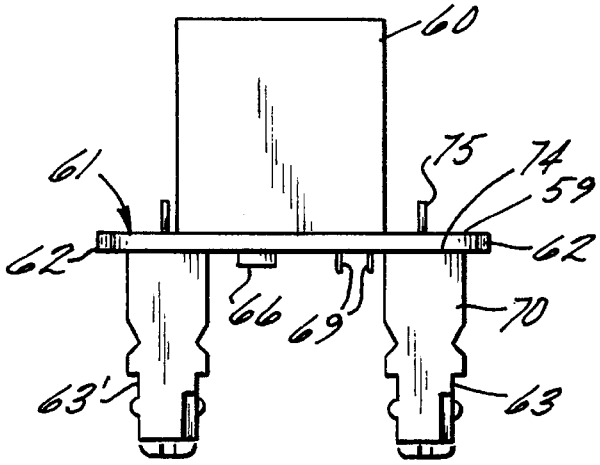
FIG. 16 is a plan view of the modular jack, mounting surface and termination blocks.
Figure 17:
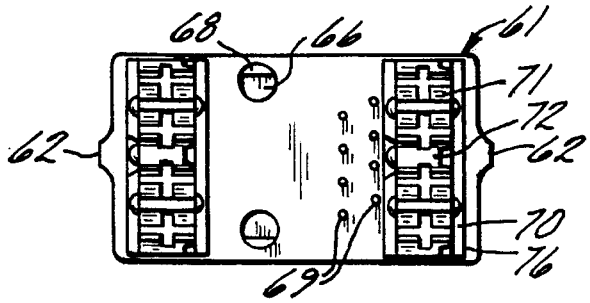
FIG. 17 is a rear view of the termination blocks and the mounting surface.

In the most preferred embodiment, interconnecting apparatus 61 is a printed circuit board 59, including opposing surfaces 64 and 65, with a pair of termination blocks 63 mounted on termination surface 65 of PC board 59, and a corresponding modular jack 60 mounted on jack surface 64. Modular jack 60 is secured to board 59 by resilient upright members 66 which are urged into openings 67 of board 59 and are retained therein by shoulders 68. Further, modular jack 60 includes leads 69 which also help secure jack 60 to board 59, and also provide electrical connection thereto. Jack 60 is commercially available from Stewart Stamping, AMP Incorporated and other modular connector manufacturers. Termination blocks 63 and 63' are of the same type as those described in U.S. Pat. No. 5,295,869 previously incorporated by reference herein. Referring to FIGS. 16 and 17, termination blocks 63 comprise single-piece molded housings 70. Housing 70 is substantially rectangular in shape and includes a plurality of spaced apart teeth 71 and 72 along the length of its upper surface. Teeth 71 and 72 alternate and are staggered in height to facilitate indexing of a set of conductors in wire stain relief slots. Also, as is conventional with connecting blocks of this type, the teeth include tapered sides to facilitate entry of the wire conductors (not shown).

A lower surface 74 of housing 70 includes a plurality of posts or leads 75 extending downwardly therefrom. Posts 75 may be of a press-fit configuration, designed to effectuate a permanent, solderless connection with plated through holes in circuit board 59. If not of the press fit variety, posts 75 may be of the solderable variety, in which case the solder secures the block to the board and makes electrical connection. Press fit posts 75 also act to physically secure blocks 63 to board 59 and are integral to individual beam contacts 76 positioned within housing 70. Spaced openings through the upper portion of housing 70 and through the staggered teeth 71, 72 form adjacent channels for receiving and positioning the beam contacts 76 during assembly to the printed circuit board.

Once the modular jack 60 is soldered into the printed circuit board, termination blocks 63 are pressed or soldered into place. It is preferred that the press-fit posts of blocks 63 allow plated through hole connections to be made from components on both sides of the printed circuit board with only a single soldering operation. This capability enables the module to realize the spacing and other packaging advantages of connectors mounted on two sides of the printed circuit board without the added expense of hand soldering, or requirements for costly, high temperature connector housing materials.

It will be appreciated that, in an alternate embodiment (not shown) it is possible to replace the termination blocks 63 with commercially available termination blocks equipped with solder tails or other connection means (e.g., AT&T Technologies series 110D connectors). It is equally possible to replace the solder-tail modular jack 60 with alternate connectors that may or may not require soldering to electrically connect to the printed circuit board.

Figure 18:
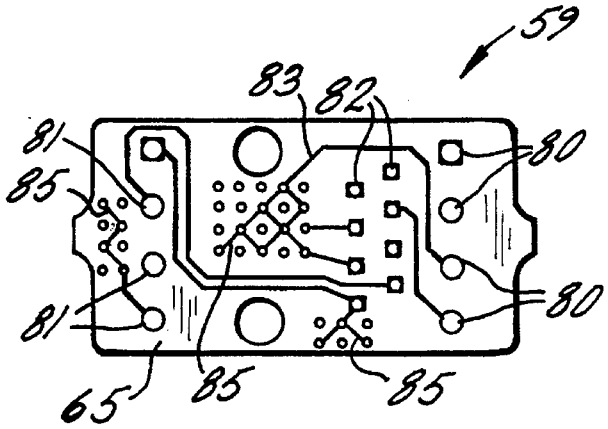
FIG. 18 is a plan view of a first side of a PC board embodiment illustrating the configuration of traces and holes.
Figure 19:
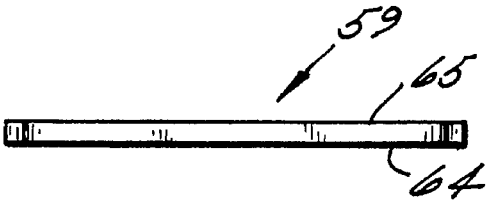
FIG. 19 is a side elevation view of FIG. 18.
Figure 20:
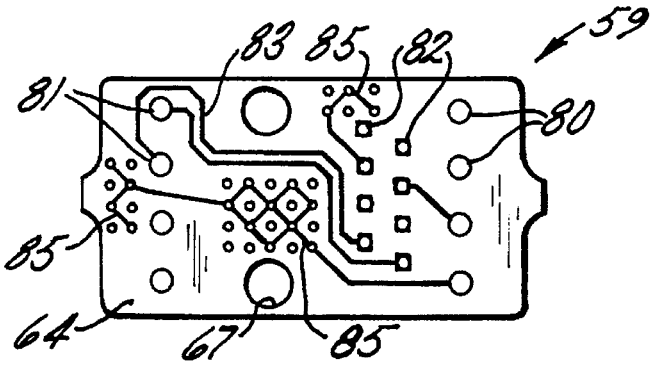
FIG. 20 is a plan view of a second side of a PC board embodiment illustrating the configuration of traces and holes.
Figure 21:
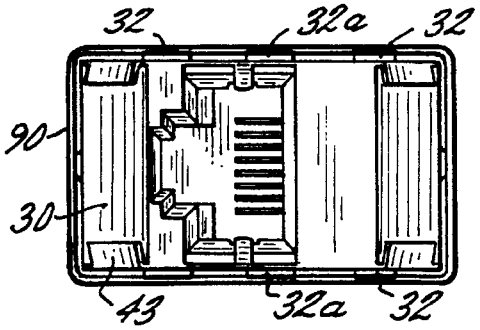
FIG. 21 is a front view of the modular jack engaged with the shielding enclosure with the shielding rear cover.
Figure 22:
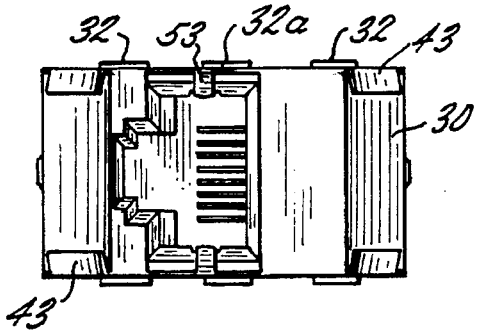
FIG. 22 is a front view of the modular jack engaged with the shielding enclosure without the shielding rear cover.
Figure 23:
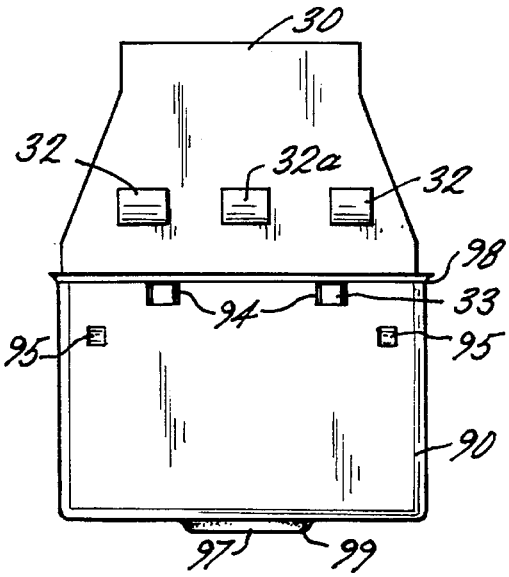
FIG. 23 is a side elevation view of the shielding assembly engaged.
Figure 24:
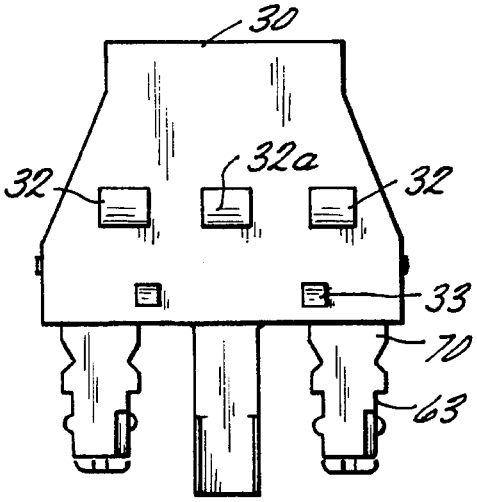
FIG. 24 is a side elevation view of the shielding enclosure with the termination blocks protruding from the rear thereof.
Figure 25:
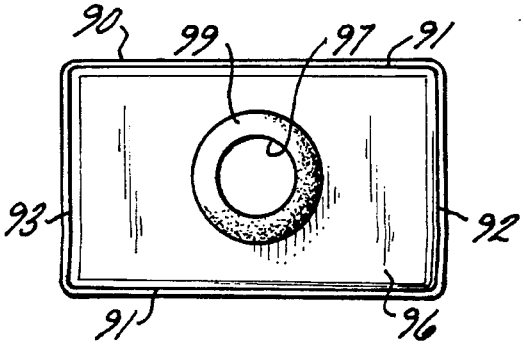
FIG. 25 is a rear view of the shielding rear cover illustrating the cable orifice.
Figure 26:
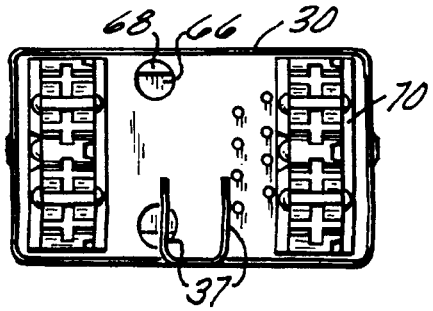
FIG. 26 is a rear view of the termination blocks and PC board nestled within the shielding enclosure.
Figure 27:
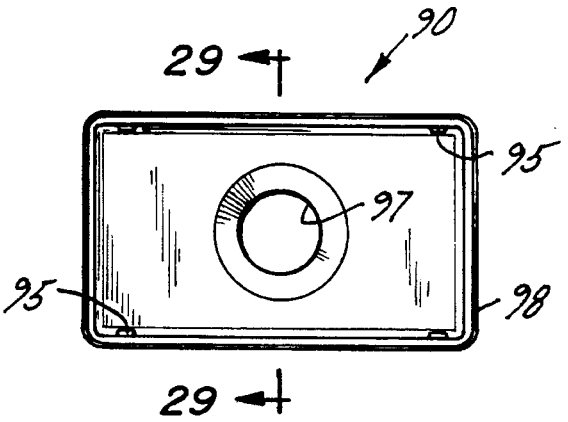
FIG. 27 is a front view of the shielding rear cover.
Figure 29:
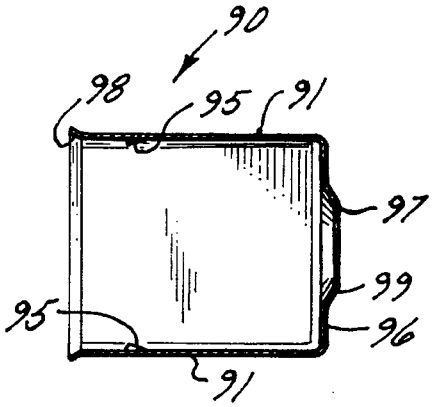
FIG. 29 is a cross section view taken along section line 29—29 in FIG. 27.
Figure 28:
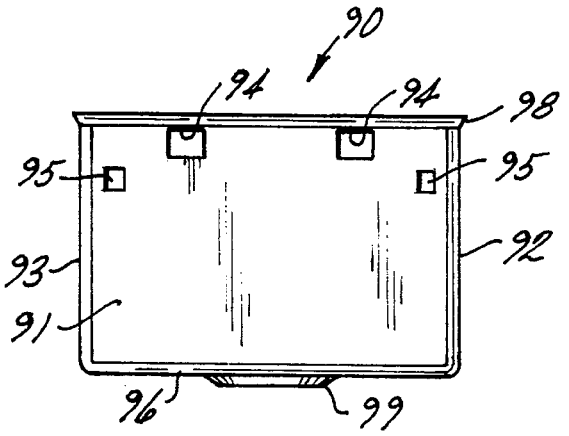
FIG. 28 is an elevational view of the shielding rear cover.
Figure 30:
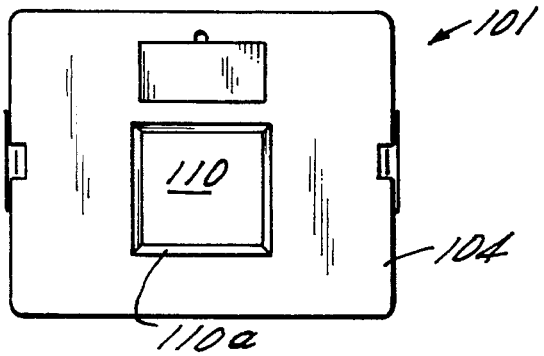
FIG. 30 is a first view of an alternate embodiment of the panel yoke of the invention.
Figure 31:
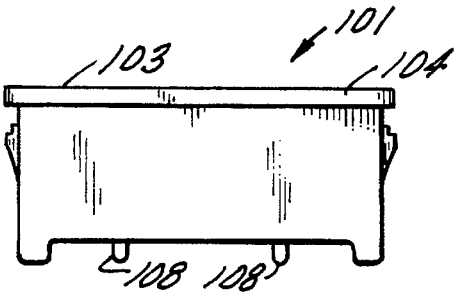
FIG. 31 is a plan view of an alternate embodiment of the panel yoke of the invention.
Figure 32:
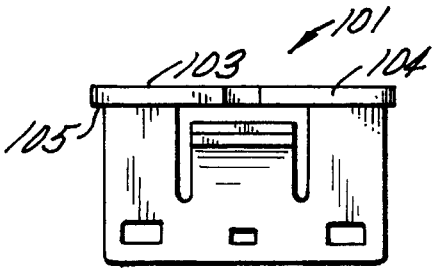
FIG. 32 is a side view of an alternate embodiment of the panel yoke of the invention.

Referring now to FIGS. 18–20, circuit board 59 is shown. Board 59 is a two-sided printed circuit board having a plurality of vias or feed-through holes therethrough. A first set of holes 80 accepts blocks 63, a second set of holes 81 accepts block 63', a third set of holes 82 accepts jack 60. Surfaces 64 and 65 of board 59 include a plurality of circuit traces 83 interconnecting holes 80 and 81 with holes 82 in a predetermined configuration, thereby providing interconnection of block 63' with jack 60. The configuration of the traces is determined by the application of the device, and generally conforms with a selected industry standard.

A first side 65 of printed circuit board 59 includes several grids of circuitry 85 connecting to holes, having vias or through holes that are interconnected in substantially diagonal patterns which, in turn, are selectively connected to circuit traces in such a way as to introduce an impedance between the individual circuit paths provided between holes 80, 81 and 82 respectively; each of which function as one side of a reactive element. Likewise, a second side of printed circuit board 64 includes a grid of circuitry connecting to pads, having vias or through holes that are also interconnected in substantially diagonal patterns which, in turn, are selectively connected to other circuit traces each of which function as a second side of a reactive element. It will be appreciated that the grid of circuitry connecting to pads having vias or through holes that are interconnected in substantially diagonal patterns and the grid of circuitry connected to pads, having vias or through holes that are also interconnected in substantially diagonal patterns are not directly connected, but are specially arranged in such a way as to generate a desired amount of reactive coupling between the circuit traces connected to the circuit grids. The attachment of the pads may be facilitated either in shunt (parallel) or the current in one or more traces may be forced to pass through the pads, thereby maximizing reactance.

The advantages of using through holes, as opposed to discrete components to perform the tuning function that is necessary to achieve a desired level of transmission performance are many. Because they require no added components or secondary assembly operations, as do discrete components, the reactive through holes offer inherent advantages with respect to manufacturing cost as well as product reliability; manufacturability and electrical integrity.

It will be appreciated that in an alternate embodiment (not shown), the diameter and spacing of the through holes may change as required by the physical and electrical constraints of the application or industry standard. Also, the pattern and width of the circuitry that forms grids and pads may vary according to the requirements of the individual outlet or connector. This method of achieving a controlled amount of reactive coupling between selected circuit paths of a connector is an important feature of the present invention. They allow reactive imbalance between pairs that is caused by certain outlet wiring schemes and wire connectors to be compensated for, by the printed circuitry and through holes so as to allow a connection device to meet or exceed Category 5 requirements.

The benefits of "Category 5" devices are readily appreciated by one of ordinary skill in the art.

Finally referring to FIG. 1 and FIGS. 27–29, the last element of the shielded connector assembly is illustrated. Shielding rear cover 90 is a five sided object in a substantially rectangular cubical shape having two side sections 91, a top section 92 a bottom section 93 and a rear cap 96. Side sections 91 are identical to each other and feature two engagement apertures 94 for engaging rounded engagement members 33 on shielding enclosure 30, and also feature two land indentations 95 to prevent shield enclosure 30 from sliding too deeply into shielding rear cover 90.

Shielding rear cover 90 also includes a rear cap 96 having an orifice 97 through which a cable may pass. In the most preferred embodiment orifice 97 includes a curved grommet-like structure 99 stretched directly from the material of shielding rear cover 90. Alternatively, a grommet may be inserted into orifice 97, or may be omitted.

Side sections 91 and top and bottom sections 92, 93 are connected at the lateral edges thereof and include a perimetrical flare 98 at the open end of the five sided shielding rear cover 90. Flare 98, if included, aids the slip-fit snap-locking engagement operation connecting shielding rear cover 90 to shielding enclosure 30.

Figure 42:
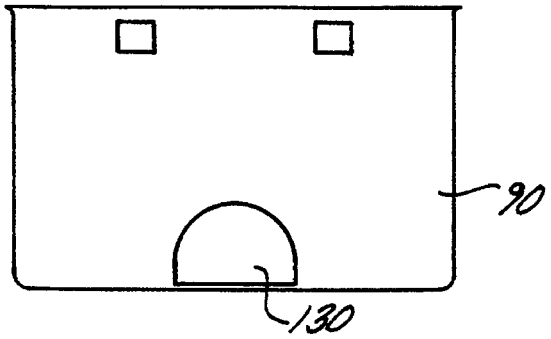
FIG. 42 is an elevation view of an alternate embodiment of the shielding rear cover of the invention.
Figure 43:
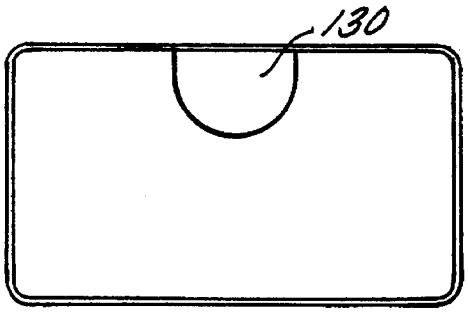
FIG. 43 is a top plan view of FIG. 42.
Figure 44:
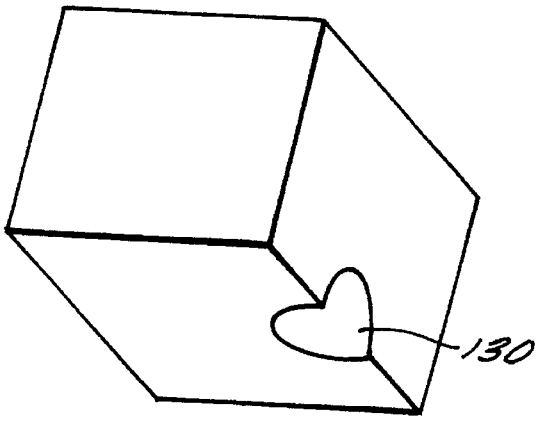
FIG. 44 is a diagrammatic perspective view of an alternate embodiment of the shielding rear cover of the invention.

Referring now to FIGS. 42, 43 and 44 an alternate embodiment of the shielding rear cover is illustrated. In these FIGURES it will be easily appreciated by one of skill in the art that the orifice 97 has been moved to be bisected by one edge of side sections 91 and is oriented partially on the rear cap 96 of rear cover 90 and partially on one of the side sections 91 of rear cover 90. The orifice in this embodiment is indicated by the numeral 130. In other respects shielding rear cover is identical to that discussed hereinbefore.

Shielding rear cover 90 is most preferably formed by a deep draw process. This process is most preferred since it creates a cover having no seams. An arrangement where such a cover has no seams is beneficial both in light of the added structural rigidity exhibited by the cover and because there are no leaks for radio wave transmission.

As an aid to understanding the assemblage described herein, FIGS. 21–26 illustrate various views of the shielding enclosure and shielding rear cover engaged and surrounding the termination blocks, PC board and modular jack.

Having discussed the individual parts of both embodiments of the invention and the relative interactions thereof, it if well to generally describe the manner of assembly of the various pieces. Assuming then that interconnecting device 61 has been inserted into enclosure 30 by deforming the sides thereof until the projections 62 align with and slide into openings 47, the subassembly just described is fit into yoke 2, aligned so that relevant openings in the yoke 2 and enclosure 30 provide through passage for the plug to fit into the jack 60. Shielding enclosure 30 is maintained in yoke 2 as set forth above. The cable to be connected is then terminated to termination blocks 70 and the shield connected to cable shield restraint 36. As will be quite apparent to those of skill in the art, cover 90 is placed over the cable before termination. Once termination is completed, cover 90 is pressed onto enclosure 30 until snapped together as above described. The shield (enclosure and cover) is then the first part to be inserted through a panel and the panel yoke 2 is snap lockingly engaged with the panel.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A shielded connector assembly comprising:

a) a panel yoke:

b) a shielding assembly snap fittingly engageable with said panel yoke;

c) an interconnecting assembly for interconnecting a cable and a remote device said interconnecting assembly being snap fittingly engageable with said shielding assembly and being enclosed by said shielding assembly, said shielding assembly further providing a single continuous low impedance path from a first cable to a connected cable.

2. A shielded connector assembly as claimed in claim 1 wherein said panel yoke comprises:

plate means having front and back opposing surfaces and first and second apertures therethrough;

first and second opposing sides extending normally from said back surface of said plate means;

top and bottom opposing walls extending normally from said back surface of said plate means, said top and bottom walls being disposed perimetrically between said first and second sides;

means for snap lockingly securing said panel yoke to a panel;

locating means for locating and snap locking said shielding assembly within a compartment created by said top and bottom walls, one of said sides and a center wall extending from said back surface of said plate means.

3. A shielded connector assembly as claimed in claim 1 wherein said interconnecting means comprises:

a) a printed circuit board operably connected to a modular jack on a first surface thereof and to a pair of wire termination blocks on a second surface thereof.

4. A shielded connector assembly as claimed in claim 3 wherein said printed circuit board includes:

circuitry disposed thereon, said circuitry comprising a plurality of pads and circuit traces; and at least one reactive element integrally defined within said circuit board and connected to said circuitry, said at least one reactive element comprising a plurality of plated through holes, said plated through holes being spaced and interconnected in a defined configuration to obtain a desired reactance for restoring electrical balance to the transmission lines wherein crosstalk between the transmission lines is reduced.

5. A shielded connector assembly as claimed in claim 1 wherein said interconnecting means is a printed circuit board, said board having circuitry including a plurality of conductive through holes, said conductive through holes being arranged and interconnected to define at least one reactance;

jack means disposed on said circuit board and connected by said circuitry to at least one of said conductive through holes defining said at least one reactance; and termination block means disposed on said circuit board and connected by said circuitry to said jack means and to at least one of said conductive through holes defining said at least one reactance;

wherein said reactance restores electrical balance between said jack means and said terminal block means.

6. A shielded connector assembly as claimed in claim 5 wherein said circuit board includes:

a first surface having said jack means disposed thereon; and a second surface opposed to said first surface, said second surface having said termination block means disposed thereon.

7. A shielded connector assembly as claimed in claim 5 wherein said termination block means comprises:

a housing having first and second spaced apart sidewalls and an upper surface having a plurality of openings therethrough;

a plurality of spaced apart insulation penetrating beam contacts disposed in said opening of said housing, said beam contacts connected to said circuit board; and a plurality of spaced apart teeth extending from said upper surface, said teeth defining wire conductor retaining slots.

8. A shielded connector assembly as claimed in claim 1 wherein said interconnecting means is a PC board, said board having circuitry including a plurality of conductive through holes, said conductive through holes being arranged and interconnected to define at least one reactance;

first connector means disposed on said circuit board and connected by said circuitry to at least one of said conductive through holes defining said at least one reactance; and second connector means disposed on said circuit board and connected by said circuitry to said first connector means and to at least one of said conductive through holes defining said at least one reactance;

wherein said reactance restores electrical balance between said first connector means and said second connector means.

9. A shielded connector assembly as claimed in claim 8 wherein said circuit board includes:

a first surface having said first connector means, disposed thereon; and a second surface opposed to said first surface, said second surface having said second connector means disposed thereon.

10. A shielded connector assembly as claimed in claim 8 wherein said first connector means comprises a jack.

11. A shielded connector assembly as claimed in claim 8 wherein said second connector means comprises a termination block.

12. A shielded connector assembly as claimed in claim 1 wherein said interconnecting means is a hard wired modular jack.

13. A shielded connector assembly as claimed in claim 1 wherein said shielding means is a material coated with an electrically conductive material.

14. A shielded connector assembly as claimed in claim 13 wherein said material is plastic.

15. A shielded connector assembly as claimed in claim 13 wherein said material is metal.

16. A shielded connector assembly as claimed in claim 13 wherein the electrically conductive material is a tin/lead mixture.

17. A shielded connector assembly comprising:

a) a panel yoke having 1) a face plate having opposing first and second surfaces, said first surface including at least one opening extending from said first surface to said second surface said opening being chamfered about a periphery thereof adjacent said first surface 2) a first pair of opposing walls substantially parallel to one another and a second pair of opposing walls substantially parallel to one another and substantially perpendicular to said first pair of opposing walls in addition to being substantially perpendicular to said face plate, both of said first and second pair of opposing walls extending from said second surface of said face plate;

3) locating and stiffening ribs disposed on said first pair of opposing walls said ribs including receptacle means;

4) means for snap lockingly securing said panel yoke to a panel;

b) shielding means having a polygonal shape including a front plate having an aperture for accommodating through passage of a modular plug said passage being aligned with said at least one opening in said face plate of said panel yoke, said shielding means further including a pair of opposing side plates extending rearwardly from a rear surface of said front plate, each of said side plates including a first pair of engaging means for engaging said receptacle means in said panel yoke and a second pair of engagement means, said shielding means further including a top plate and a bottom plate disposed generally perpendicularly to said side plates and extending from said rear surface of said front plate in a diverging relationship to one another, said top and bottom plates each further including an aperture located proximate to a widest distance between said top and bottom plates, said shielding means further including a rear cover having first and second pairs of opposed panels each pair being substantially perpendicular to the other pair and extending forwardly from a rear panel, said rear panel including an orifice for accepting through passage of a cable, said first pair of opposed panels having engagement apertures for engaging said second pair of engagement means;

c) interconnecting means for interconnecting said cable to an external device said interconnecting means having means for engaging said shielding means to maintain said interconnecting means completely enclosed within said shielding means.

18. A shielded connector assembly as claimed in claim 17 wherein said shielding means further includes plug alignment and retention means.

19. A shielded connector assembly as claimed in claim 18 wherein said plug alignment and retention means is a pair of fingers projecting from a periphery of said through passage toward a center thereof.

20. A shielded connector assembly as claimed in claim 19 wherein said fingers include a radius along their length and a curvature at ends thereof distal from said periphery of said through passage.

21. A shielded connector assembly as claimed in claim 1 wherein said panel yoke comprises:

plate means having front and back opposing surfaces and at least one through-aperture;

first and second opposing sides extending generally perpendicularly from said back surface of said plate means;

top and bottom opposing walls extending generally perpendicularly from said back surface of said plate means said top and bottom walls being disposed perimetrically between said first and second sides;

at least two interior walls extending from said back surface of said plate means, adjacent said through-aperture on either side thereof;

means for snap lockingly securing said panel yoke to a panel locating means for locating and snap locking said shielding assembly within a compartment defined by said top and bottom walls and said at least two interior walls.

22. A shielded connector assembly as claimed in claim 21 wherein said interior walls extend between and connect with said top and bottom walls.

23. A shielded connector assembly as claimed in claim 21 wherein said interior walls include engagement means for engaging a shielding enclosure.

24. A shielded connector assembly as claimed in claim 22 wherein said engagement means is a recess in each interior wall adapted to engage at least one pawl on said shielding assembly.

25. A shielded connector assembly as claimed in claim 1 wherein said shielding assembly comprises a two-piece construction of an electrically conductive material, said two-piece construction being dimensioned to enclose a telecommunications interconnecting device to interconnect one cable with another such that said device is enclosed in said electrically conductive material, said cables entering said shielding assembly through respective apertures in said assembly.

26. A shielded connector assembly as claimed in claim 25 wherein one of said apertures is located in a face of said assembly through which a modular plug passes and one of said apertures allows passage of an incoming cable.

27. A shielded connector assembly as claimed in claim 17 wherein on at least one of said pair of side plates is a cable retention means for retaining an incoming cable.

28. A shielded connector assembly as claimed in claim 27 wherein said cable retention means comprises an extension from at least one of said side plates and a means for cradling said cable.

29. A shielded connector assembly as claimed in claim 28 wherein said cable retention means includes two wings disposed distally on said extension from said side plate and extending from opposite edges of said extension.

30. A shielded connector assembly as claimed in claim 29 wherein said wings include sockets for engagement of a drain wire from said incoming cable.

31. A shielded connector assembly as claimed in claim 27 wherein said retention means comprises a plurality of extensions including a spike and at least two cable retention members.

32. A shielded connector assembly as claimed in claim 31 wherein said spike is curved longitudinally to substantially match the curvature of a cable shield.

33. A shielded connector assembly as claimed in claim 31 wherein said at least two cable retention members are located one on each side of said spike.

34. A shielded connector assembly as claimed in claim 33 wherein each of said cable retention members include at least one lug.

35. A shielded connector assembly as claimed in claim 33 wherein each of said cable retention members include at least one lug and at least one burr.

36. A shielded connector assembly as claimed in claim 25 wherein said two piece construction is connectable by an engagement means on one of said two-pieces with apertures complimentarily positioned in the other of said two pieces.

37. A shielded connector assembly as claimed in claim 36 wherein said engagement means is at least one pawl.

38. A shielded connector assembly as claimed in claim 36 wherein said engagement means is at least one latch.

39. A shielded connector assembly as claimed in claim 38 wherein said latch is defined by two slits in a material of said shielding assembly and wherein the material between the two slits is stretched away from said material of said shielding assembly to be in a rounded configuration.

40. A shielded connector assembly as claimed in claim 17 wherein said orifice is located centrally in said rear panel of said rear cover.

41. A shielded connector assembly as claimed in claim 17 wherein said orifice is located partially on said rear panel of said rear cover and partially on one of said opposed panels of said rear cover.

42. A shielded connector assembly as claimed in claim 1 wherein said shielding assembly includes at least one pawl for said snap fitting engagement with said panel yoke.

43. A shielded connector assembly as claimed in claim 21 wherein said shielding assembly includes at least one pawl for said snap fitting engagement with said at least one interior wall.

44. A shielded connector assembly as claimed in claim 17 wherein said rear cover includes at least one stop for locating said shielding enclosure within said rear cover.

45. A shielded connector assembly as claimed in claim 38 wherein said latch is defined by a single slit in a material of said shielding assembly and wherein said material immediately adjacent said slit is stretched away from the remainder of said material to produce a stretched area having a partially conical appearance.

* * * * *

UNITED STATES PATENT AND TRADEMARK OFFICE

CERTIFICATE OF CORRECTION

PATENT NO. : 5,518,423
DATED : May 21, 1996
INVENTOR(S) : Martin Green et al.

It is certified that error appears in the above-identified patent and that said Letters Patent is hereby corrected as shown below:

Column 6,
Line 43, after “effect” (1st occurrence), delete “the ramp effect”

Column 7,
Line 18, delete “lea” and insert therefor -- left --
Line 48, after “38a”, delete “cable”

Column 8,
Line 12, delete “or” and insert therefor -- of --
Line 22, after “pair” insert -- of --

Column 9,
Line 6, after “30”, insert -- Projections 62 are engaged by deforming top plate to slide apparatus 61 into position. --

Column 11,
Line 35, after “it” delete “if” and insert -- therefor -- is --

Signed and Sealed this

Twenty-seventh Day of August, 2002

*Attest:*

*Attesting Officer*

JAMES E. ROGAN
*Director of the United States Patent and Trademark Office*